US007913462B2

(12) United States Patent
Woodcock

(10) Patent No.: US 7,913,462 B2
(45) Date of Patent: Mar. 29, 2011

(54) STRUCTURAL MEMBER FOR BUILDINGS AND METHODS OF USE

(76) Inventor: Jerry A. Woodcock, Wheat Ridge, CO (US)

( * ) Notice: Subject to any disclaimer, the term of this patent is extended or adjusted under 35 U.S.C. 154(b) by 415 days.

(21) Appl. No.: 12/033,010

(22) Filed: Feb. 18, 2008

(65) Prior Publication Data

US 2008/0196348 A1 Aug. 21, 2008

Related U.S. Application Data

(63) Continuation-in-part of application No. 11/161,048, filed on Jul. 20, 2005, now abandoned.

(51) Int. Cl.
*E04B 1/32* (2006.01)
*E04B 1/342* (2006.01)
*E04B 7/08* (2006.01)

(52) U.S. Cl. ..... 52/80.1; 52/1; 52/81.1; 52/81.2; 52/81.6

(58) Field of Classification Search ..... 52/1, 80.1, 52/81.1, 81.2, 81.6
See application file for complete search history.

(56) References Cited

U.S. PATENT DOCUMENTS

| | | | | | |
|---|---|---|---|---|---|
| 3,994,108 | A * | 11/1976 | Johnson | 52/247 |
| 4,067,153 | A * | 1/1978 | Davis | 52/81.1 |
| 4,378,560 | A * | 3/1983 | Khorsand | 343/912 |
| 4,442,639 | A * | 4/1984 | Lindsey et al. | 52/73 |
| 4,565,149 | A * | 1/1986 | Clasky et al. | 114/264 |
| 4,677,796 | A * | 7/1987 | Mellott | 52/73 |
| 4,848,047 | A * | 7/1989 | Sneyd | 52/81.2 |
| 5,094,044 | A * | 3/1992 | Dykmans | 52/80.1 |
| 5,325,642 | A * | 7/1994 | Cooley | 52/81.1 |
| 5,394,661 | A * | 3/1995 | Noble | 52/167.4 |
| 5,471,804 | A * | 12/1995 | Winter, IV | 52/220.1 |
| 5,918,438 | A * | 7/1999 | South | 52/745.07 |
| 6,401,404 | B1 * | 6/2002 | Fillipp et al. | 52/80.1 |
| 6,557,316 | B2 * | 5/2003 | Van Der Heijden | 52/585.1 |
| 6,938,381 | B1 * | 9/2005 | Villa | 52/79.1 |
| 7,152,384 | B1 * | 12/2006 | McCarty | 52/639 |
| 2005/0210767 | A1 * | 9/2005 | DeFever et al. | 52/80.1 |
| 2009/0025306 | A1 * | 1/2009 | Reed | 52/80.1 |
| 2009/0025307 | A1 * | 1/2009 | Crichlow | 52/81.1 |
| 2009/0049763 | A1 * | 2/2009 | Blundell et al. | 52/81.1 |

* cited by examiner

*Primary Examiner* — Richard E Chilcot, Jr.
*Assistant Examiner* — Mark R Wendell
(74) *Attorney, Agent, or Firm* — Don D. Cha; Hamilton DeSanctis & Cha

(57) ABSTRACT

The present invention provides structural members for buildings, methods for using the same, and building structures comprising such structural members. In particular, the present invention provides buildings that can withstand natural disasters such as earthquakes, floods, high winds such as hurricanes and tornadoes, and other natural disasters.

19 Claims, 8 Drawing Sheets

STRUCTURAL MEMBER FOR BUILDINGS AND METHODS OF USE

CROSS-REFERENCE TO RELATED APPLICATIONS

This application is a Continuation-In-Part of U.S. application Ser. No. 11/161,048, filed Jul. 20, 2005, which is incorporated herein by reference in its entirety.

FIELD OF THE INVENTION

The present invention relates to structural members for buildings, methods for using the same, and building structures comprising such structural members.

BACKGROUND OF THE INVENTION

Globally there is a need for housing that is resistant to various natural disasters such as earthquakes, windstorms, and floods. It is also advantageous to the owners, and the communities in which they live, when such housing is well-built, cost efficient, energy efficiency, and less labor intensive to build. However, the foremost concern in many communities throughout the world is housing that can withstand many natural disasters.

Natural disasters typically wipe-out an entire community or city and communities struggle to rebuild and reorganize. The lack of adequate housing after a natural disaster has effects that go beyond the immediate lack of shelter for individuals. A lack of housing makes education, community organization and other goals more difficult to reach because of the transitory nature of a homeless population and the need for resources to support the population.

Numerous attempts have been made to develop affordable and adequate housing including the development of improved building structures. Building structures that are inexpensive to create, however, are frequently weak and offer poor weather resistance. Stronger building structures are more difficult to construct which adds to the cost of building.

From igloos, through geodesic domes, to hemispherical domes made by spraying a cementitious material over an inflated bladder, throughout history there have been many types of truncated domes used as dwellings and commercial buildings. Most of these buildings are aesthetically pleasing and offer suitable shelter, but the majority of these types of buildings are not well suited to withstand a variety of natural disasters.

Accordingly, there is a need for building structures that can withstand many natural disasters, yet are reasonably priced, and are aesthetically pleasing.

SUMMARY OF THE INVENTION

Some aspects of the invention provide a structural member of a building comprising a plurality of beams that are held together at least in part by a post-tension cable within each of said beam.

In some embodiments, the beam comprises a body and at least one joint section for attaching to another beam.

Yet in other embodiments, each of said beam comprises a plurality of post-tension cables.

Still in other embodiments, the post-tension cable is located within the body of said beam. Within these embodiments, in some instances the body of the beam further comprises a conduit and wherein the post-tension cable is located within the conduit.

Other embodiments of the invention include the plurality of beams forming a dome-shape. In other embodiments, the plurality of beams form a substantially spherical shape.

In other embodiments, at least some of said beams are attached to a central column. Within these embodiments, in some instances the beams are held in place relative to said central column at least in part by said post-tension cable. In other instances within these embodiments, the central column is segmented. Still in other instances within these embodiments, the central column comprises a plurality of radially emanating beams.

Other aspects of the invention provide a prefabricated structural beam comprising a body comprising a conduit therein; and at least one joint section for attaching to another beam.

In some embodiments within these aspects, the body comprises a plurality of conduits.

Still in other embodiments, at least one of the joint section comprises a width that is substantially less than the length of the body.

Yet other aspects of the invention provide a building comprising a plurality of beams, wherein at least about 50% of said plurality of beam are held together at least in part by a post-tension cable within each of said beam.

In some embodiments, at least a portion of the plurality beams are latitudinal beams. Within these embodiments, in some instances the building comprises a plurality of latitudinal beams.

In other embodiments, at least a portion of said plurality beams are longitudinal beams. Within these embodiments, in some instances the building comprises a plurality of longitudinal beams. In other instances within these embodiments, at least a portion of the longitudinal beams are attached to a central column. In some cases, the central column further comprises a plurality of radially emanating beams.

Still in other embodiments, the plurality of beams form a substantially spherical shape.

Still other aspects of the invention provide a building structure comprising:

- a central beam having an upper portion and a lower portion;
- a plurality of longitudinal support beam sets, each set of said longitudinal support beam extends substantially from the upper portion of said central beam to substantially the lower portion of said central beam, wherein each longitudinal support beam set comprises:
  - a plurality of vertical sectional beams, each of said vertical sectional beam having:
    - first and second ends that vertically define upper and lower ends of said vertical sectional beam; and
    - outer and inner surfaces that radially define from said central beam an outer surface and an inner surface, respectively, of said vertical sectional beam,
  - and wherein each vertical sectional beam is in the form of a vertical arc;
- at least one set of radial beams, wherein each radial beam in the set extends radially from different location but substantially the same vertical position of said central beam, each radial beam having a distal end that is distal to said central beam and a proximal end that is proximal to said central beam; and
- at least one set of latitudinal support beams that substantially defines a circumference of said set of radial beams, wherein said set of latitudinal support beams comprises a plurality of horizontal sectional beams, each of said horizontal sectional beam having:
  - first and second ends that horizontally define ends of said horizontal sectional beam; and outer and inner surfaces that radially define from said central beam an outer surface and an inner surface, respectively, of said horizontal sectional beam, and wherein each horizontal sectional beam is in the form of a horizontal arc, wherein the distal end of each of said radial beam and/or the proximal end of yet another set of radial beams, is connected to the first or the second end of said vertical sectional beam and first or the second end of said horizontal sectional beam.

In some embodiments, the building further comprises a skin supported at least in part by the longitudinal support beams.

Yet in other embodiments, the building structure comprises a plurality of latitudinal support beam sets.

Still in other embodiments, the building structure comprises a plurality of radial beam sets.

In other embodiments, the number of radial beam sets is equal to the number of longitudinal and/or latitudinal support beam sets. In some instances within these embodiments, each latitudinal support beam set defines the circumference of a corresponding radial beam set.

Yet in other embodiments, a set and/or sets of radial beams define a floor.

Still yet in other embodiments, the building structure further comprises a post-tension cable within each of the beam. In some instances within these embodiments, the post-tension cable is encapsulated within a body of said beam.

Still other aspects of the invention provide methods for building a structure comprising the structural members and/or beams as disclosed herein.

DETAILED DESCRIPTION OF THE INVENTION

Figure 1A:
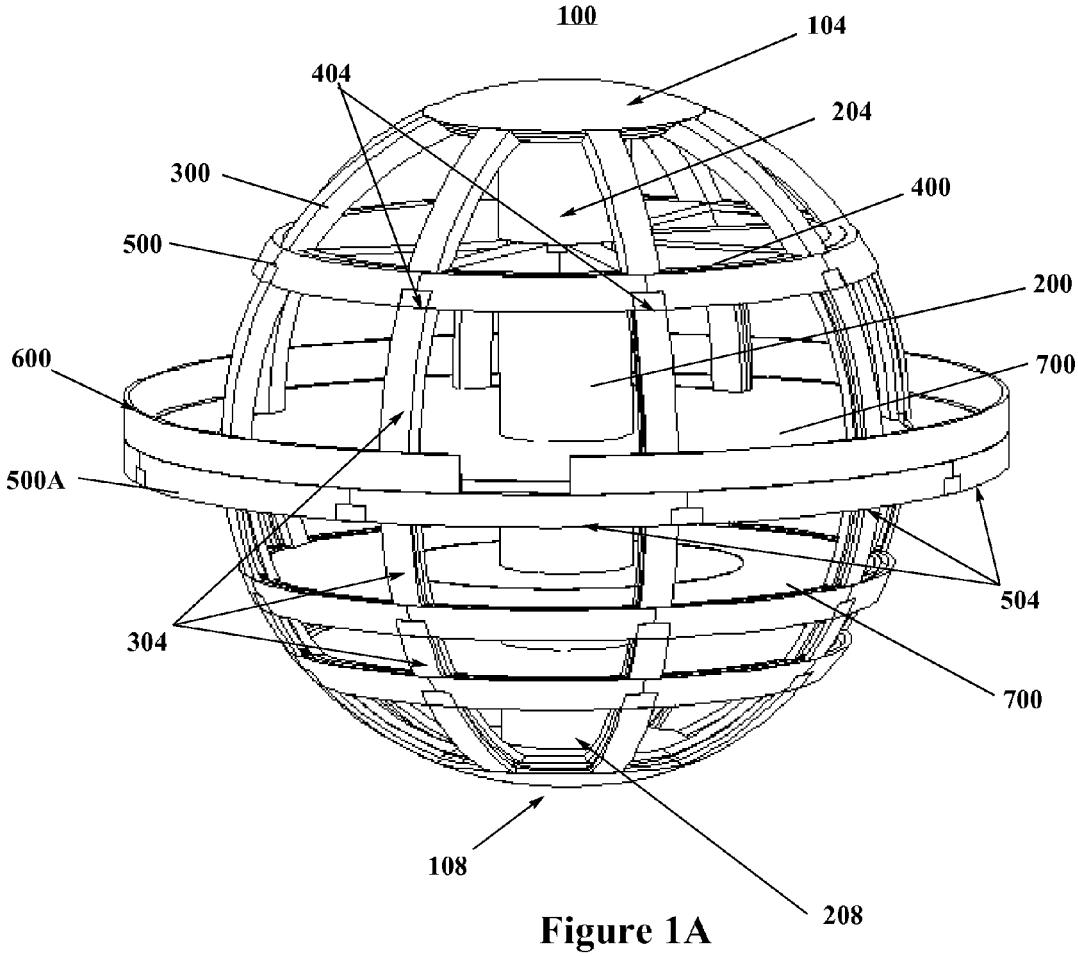
FIGS. 1A and 1C are different perspective illustrations of over-all view of one particular building structure embodiment of the invention.

Some aspects of the invention will be described with regard to the accompanying drawings which assist in illustrating various features of the invention. In this regard, the invention generally relates to structural members and building structures comprising the same.

Some embodiments of the building structures and structural members of the invention are generally illustrated in the accompanying figures, which are provided only as illustrations and do not constitute limitations on the scope of the invention.

Referring to FIGS. 1A-1D, a building structure 100 comprising structural members of the invention includes a central beam 200 having an upper portion 204 and a lower portion 208. The building structure can optionally include an upper cap 104 and/or a lower cap 108. The central beam 200 of the building structure 100 is connected to a plurality of longitudinal support beam sets 300. When the upper cap 104 and/or lower cap 108 are present, the longitudinal support beam sets 300 are connected to these caps, otherwise the longitudinal support beam sets 300 are connected directly to upper portion 204 and lower portion 208 of central beam 200 (such alternative configuration is not shown).

As can be seen in FIGS. 1A-1D, each set of longitudinal support beam extends from upper portion 204 of central beam 200 (or from upper cap 104, if present) to lower portion 208 of central beam 200 (or to lower cap 108, if present). Each longitudinal support beam set comprises a plurality of vertical sectional beams 304. Each vertical sectional beam 304 has a first end 308 and a second end 312 that vertically define upper and lower ends, respectively.

The number of beams in the longitudinal set can vary depending on, for example, the desired size or diameter of the structure, the number of floors 700 desired and/or the amount of support that is needed to provide a stable building structure. Generally, the number of beams in each set of longitudinal support beam is n+1, where n is the number of radial beam sets 400. Moreover, each vertical sectional beam 304 has an inner and outer surfaces that radially define an inner and outer surfaces, respectively relative to central beam 200. As can be seen in FIGS. 1A-1D, each vertical sectional beam 304 is typically in the form of a vertical arc. The diameter(s) of such vertical arc can vary, for example, depending on the number of vertical sectional beams 304 in longitudinal support beam set 300 and/or the shape and/or the size of building structure 100. Moreover, the diameter of each vertical sectional beam and/or beam set can be identical or different.

Spacing of each set of longitudinal support beam 300 from one another can vary depending on a variety of factors including, but not limited to, the strength of the building structure desired, the diameter or size of the building structure 100, as well as the spacing desired. Certain other structural diameters could require other sets of longitudinal support beams. Typically, a set of longitudinal support beam 300 is placed at about 45°. See FIG. 1D. Such spacing results in eight sets of longitudinal support beams. However, as stated above, it should be appreciated that the number of longitudinal support beam sets is not limited to this specific embodiment. The number of longitudinal support beam sets can vary in order to affect the size and/or strength of the building structure 100 and/or due to the cost consideration.

The building structure 100 also includes at least one set of latitudinal support beams 500 that substantially defines a circumference of the corresponding set of radial beams 400. Each set of latitudinal support beam 500 comprises a plurality of horizontal sectional beams 504. Each horizontal sectional beam 504 has a first end and a second end that horizontally define ends of each horizontal sectional beam 504. In addition, each horizontal sectional beam 504 has an outer surface and an inner surface that radially define from central beam 200 an outer surface and an inner surface, respectively. As can be seen in FIGS. 1A-1D, each horizontal sectional beam 504 is typically in the form of a horizontal arc. The diameter of such horizontal arc can vary, for example, depending on the number of horizontal sectional beams 504 in latitudinal support beam set 500 and/or the shape of building structure 100. Moreover, diameter of each horizontal sectional beam and/or beam set can be identical or different.

The number of latitudinal support beam set 500 can vary depending on the size or diameter of the building structure and/or the number of floors desired in the building structure. The spacing of each set of latitudinal support beam 500 from one another can vary depending on a variety of factors including, but not limited to, the strength of the building structure desired, the amount of vertical space desired from one floor to another, etc. In addition some latitudinal support beam set (e.g., 500A) can be extended from the building structure 100 to form extended floor area or an exterior patio or deck. Such patio or deck can optionally include a railing or a safety ledge 600.

Figure 1B:
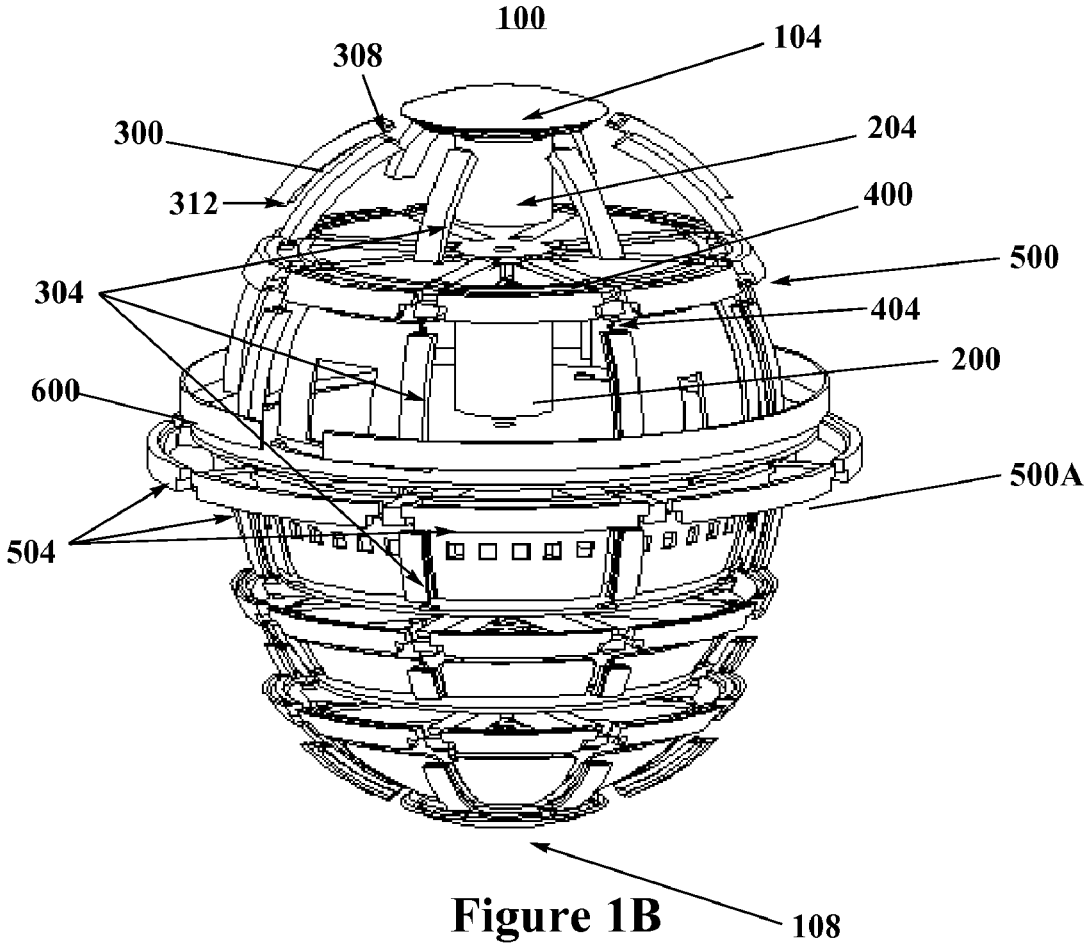
FIG. 1B is a schematic view showing how structural members fit together.
Figure 1C:
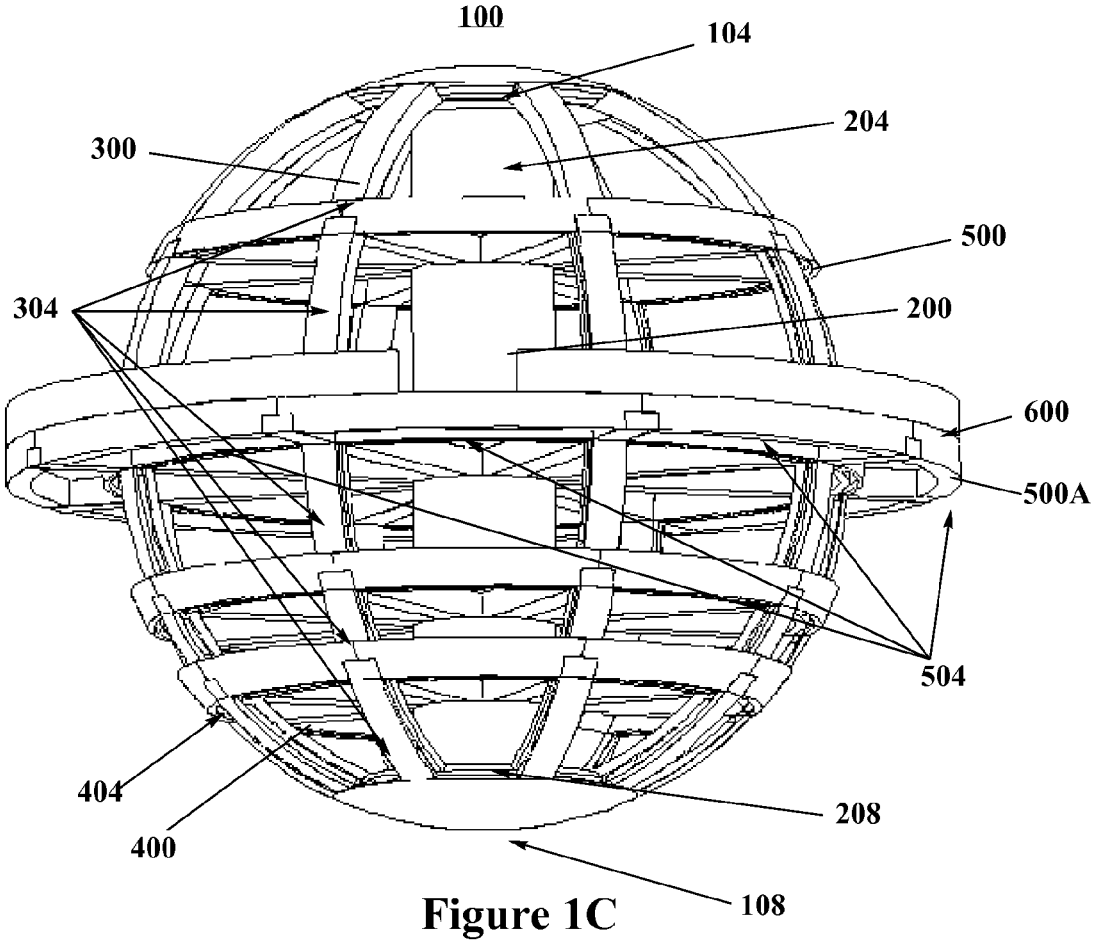

As mentioned above, the distal and/or proximal end of each radial beam is connected to the first or the second end of vertical sectional beam 304 and first or the second end of horizontal sectional beam 504. Referring to FIGS. 2A and 2B, in some embodiments in order to facilitate joining (i.e., connecting) vertical support beams and/or horizontal support beams, radial beams 400 at or near the distal end 404 has an indentation 408 where the support beam to be connected is placed. As can be seen in FIGS. 1A-1D and 2B, the horizontal support beam 504 also comprises a corresponding indentation at its ends where the connecting horizontal support beams 504 rest on top of indentation 408. In some embodiments, indentation 408 of radial beam 400 is sufficiently large enough to accommodate both horizontal support beam 504 and vertical support beam 304 which also has indentation 316 at its end. In other embodiments, the vertical support beam 304 simply rests on top of the horizontal support beam 504 where it is connected to the radial beam 400. Alternatively, the horizontal support beam 504 has a protuberance 508 at its ends opposite from its indentation such that the two horizontal support beams 504 when connected to each other forms a protuberance that can be used to join indentation 316 on the end of vertical support beam 300.

In some embodiments, a protuberance 412 is present on radial beam 400 side opposite of indentation 408. The presence of protuberance 412 on radial beam 400 in combination with indentation 316 on vertical support beam 300 allows formation a tight junction between radial beam 400 and vertical support beam 300. As shown in FIG. 2A, in the central radial beam set, radial beam 400 has indentation 408 and protuberance 412 at a position away from the distal end of radial beam 400. This allows the walls or skin of building structure 100 to be positioned away from the distal end of radial beam 400. The remaining portion of radial beam 400 can be used as a support for a patio or a deck.

Figure 3:
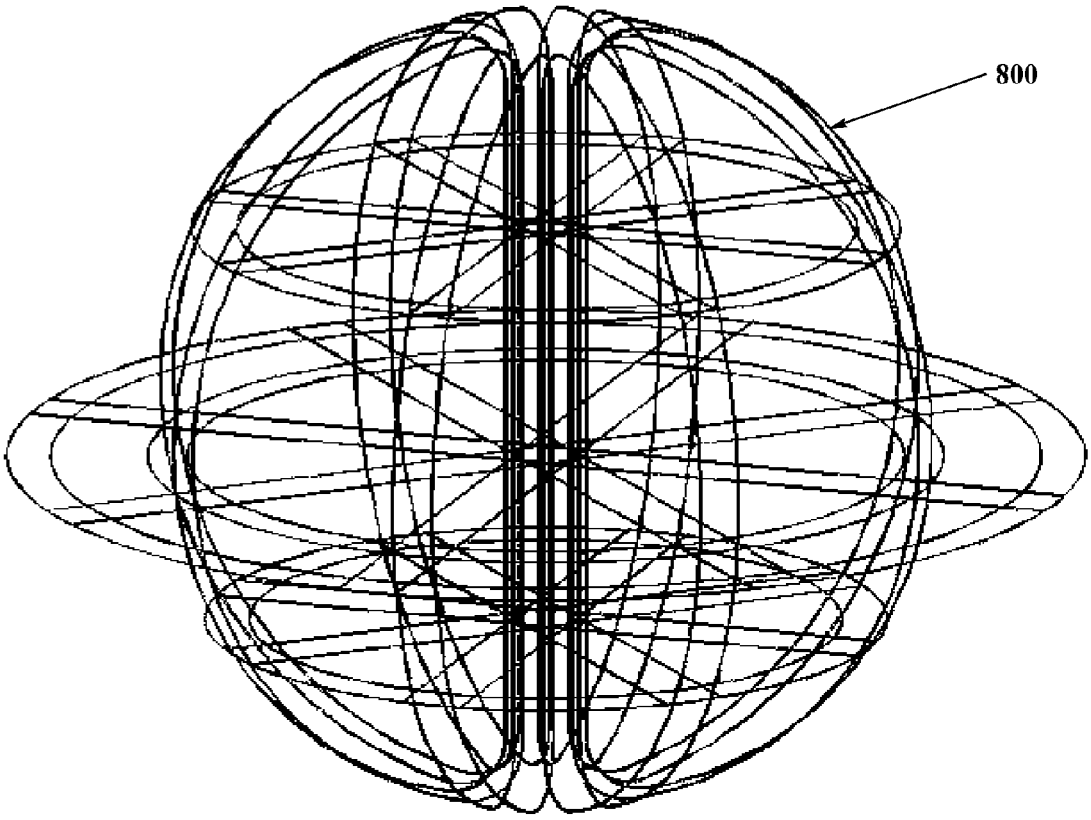
FIG. 3 is an isometric view of post-tensioned cables showing the post-tensioned cable scheme running radially, latitudinally and longitudinally through the beams and vertically through the central beam.

In some aspects of the invention, one or more beams comprise at least one post-tension cable 800. FIG. 3 shows a schematic representation of post-tension cables 800 in a building structure having two post-tension cables 800 within each beam. As can be see, this embodiment holds the entire structure together with post-tension cables 800. However, it should be appreciated that building structures need not have post-tension cables 800 within each beam. One can place post-tension cables 800 on only those beams that need additional structural support or the beams that are subject to bulk of the natural disaster or other structural force. Moreover, each beam can have only one post-tension cable 800 or a plurality of post-tension cables 800 depending on the amount of stability desired. Placement of post-tension cables 800 typically requires balancing the need for additional structural stability and the cost associated with increased structural stability.

Figure 4:
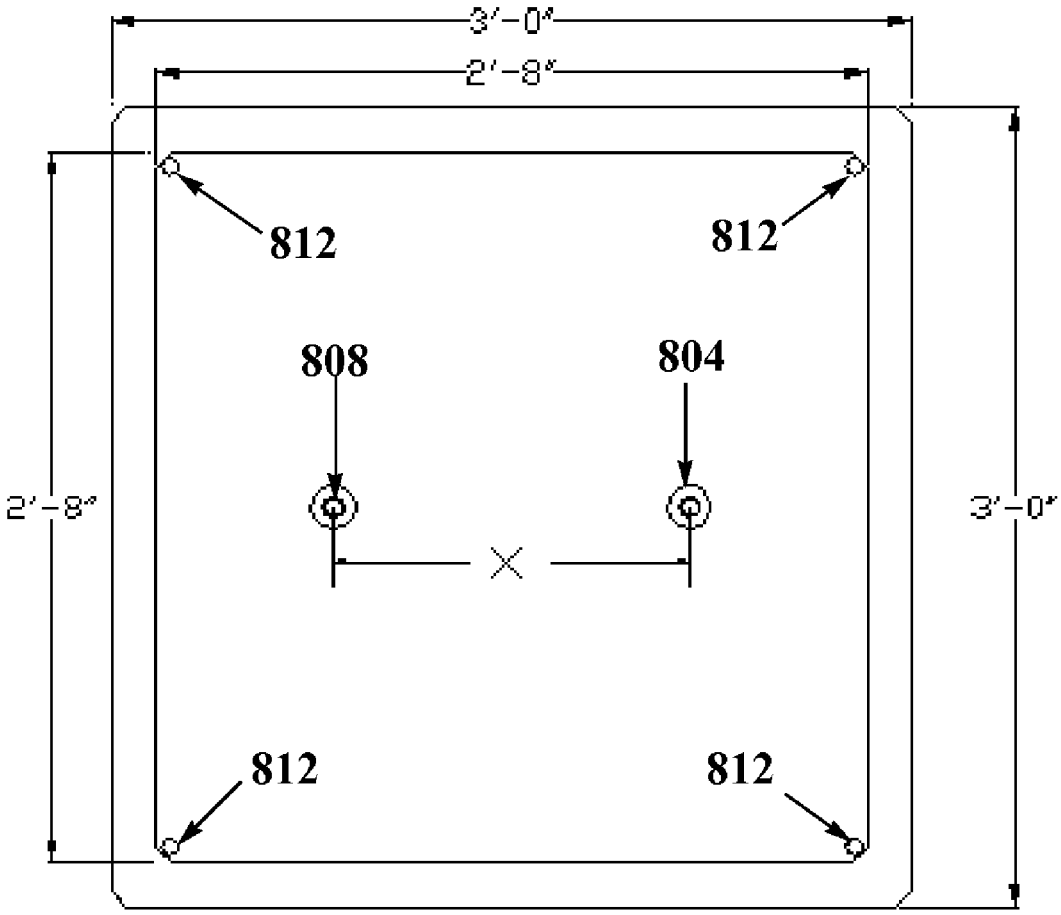
FIG. 4 is a schematic illustration of a cross section of one embodiment of a structural member beam showing the option of using conventional reinforcing steel and two post-tensioned cables for reinforcement.

As shown in FIGS. 2B and 4, often post-tension cable 800 is located within the body of each beam. However, it should be appreciated that post-tension cable 800 can also be placed outside the beam by affixing post-tension cable 800 to the beam by any methods known to one skilled in the art. When placed inside the body of a beam, post-tension cable 800 is often placed inside a conduit 804, thereby allowing some movement of post-tension cable 800 in response to an external force. Basically conduit 804 can be any conduit material such as metal tubing, polymer tubing, etc. While not necessary, an insulation 808 can be used to surround or encapsulate conduit 804 and provide protection from structural distortion, corrosion, temperature change, etc.

It is well known that metal expands and shrinks in response to temperature change. Accordingly, insulation 808 provides protection, among others, against extreme temperature change thereby reducing the amount of post-tension cable expansion and/or shrinkage. Post-tension cable 800 can be made from any material that provide sufficient mechanical strength to hold beams in place in response to an external force, such as high winds, floods, earthquakes, etc. Typically, metal cables are used as post-tension cable 800.

Referring again to FIG. 4, which is a cross-section view of a beam, in some embodiments, one or more rebar 812 can be present. This allows additional structural support, especially for those building structures having a multiple floors. In this particular embodiment of structural member, two post-tension cable 800 is used as indicated by the number of post-tension conduits 804. Dimensions of each beam can vary widely depending on the size of the building structure and the type of external force the building structure is expected to encounter. In FIG. 4, vertical support beam 304 having the cross-section of 3 feet by 3 feet is illustrated. For radial beam, the distance ("X") between two post-tension cables 800 is typically about 28 inches, for horizontal support beam, X is typically about 24 inches, and for vertical support beam, X is typically about 12 inches. However, it should be appreciated that the scope of the invention is not limited to any particular dimensions.

Building structures made from structural members of the invention offer a safe dwelling in almost any environment. Post-tensioning of the cables 800 that run through the structural members aid in ensuring that the building structure behaves as an integral unit while it maintains a degree of flexibility. Mechanical features such as overhead coiling shutters, water storage tanks with purge nozzles, and sets of cable tethers with winches along with the predominately concrete, steel and glass building components gives building structures of the invention the ability to withstand natural disasters such as high winds (e.g., hurricanes and tornadoes), floods, earthquakes, etc.

Building structures of the invention can be situated within a liquefacting medium. Such configuration allows the building structure to ride out (i.e., withstand) an earthquake by floating on the liquefacting medium while using it as a buffer from the main earthquake forces. If building structures is not located in a liquefacting medium, building structures of the invention can withstand an earthquake by flexing at the joints as the post-tensioned cables stretch while the structure absorbs and dissipates the earthquake forces.

In some embodiments, the proper management of optional tethers (not shown) of the building structure and the ballast of the water storage tanks in the lower portions of the structure allow the building structure to rise with flood waters and lower back down as the waters recede.

Building structures of the invention typically offer a much stronger structure than conventional structures by utilizing the inherent strength of a substantially complete sphere as opposed to a truncated sphere and in some aspects by utilizing structural members that are laced together in several different directions with post-tensioned cables. The inherent flexibility of the multitude of hinged connections that make up the building structures of the invention allows the building structures to distort but not fail when subjected to various forces of nature such as earthquakes, hurricanes, tornadoes and floods.

In some embodiments, each beam can be prefabricated, for example, with pre-cast concrete to allow quick assembly of the building structure. Some of the drawings will now be discussed in more detail. However, it should be appreciated that the following description of drawings are only illustrative of some embodiments of the invention and do not constitute any limitation whatsoever of the scope of the invention, unless explicitly stated otherwise.

Referring again to FIG. 4, the cross section of one particular embodiment of structural member shows the option of using conventional reinforcing steel and two post-tensioned cables to reinforce and to hold in place each structural member. Other options include, but are not limited to, using a larger or smaller beam, fiber reinforced concrete in lieu of rebar, larger post-tensioned cables, or four cables instead of two, depending on the structural requirements.

FIG. 2B is one embodiment showing how the three different types of beams (radial, latitudinal and longitudinal) interlock. Along with a protuberance (not shown, e.g., stub) on its underside near the inner end (i.e., proximal end that is proximal to central beam 200) that fits into an indentation (e.g., block-out) in central beam 200 or possibly in other beam sets, each radial beam 400 has a protuberance (e.g., stub) 412 on its underside near distal end 404 that fits into a slightly larger indentation 316 (e.g., block-out) in the top of the adjoining longitudinal beam 300 below. The ends of two adjoining latitudinal beams 500 sit in indentation 408 (e.g., a notch) left in the top portion of distal end 404 of each radial beam 400. Each of these latitudinal beams 500 has a protuberance 508 (e.g., a half stub) on the upper side of each of its ends that fits into indentation 316 (e.g., a block-out) in the bottom of the adjoining longitudinal beam 304 above.

During the fabrication or erection of the building structure, as a particular radial beam is set upon the central column and the corresponding longitudinal beam below, hollow thin-walled aluminum "sleeve pins" are used to pin the members together as well as to extend upward to provide the same pinning mechanism for the next lift of columns and beams. With their inside diameters being equal to the inside diameter of the post-tension cable conduits, the sleeve pins provide a means of erection while ensuring that the post-tension cables can be easily threaded through the intersections of columns and beams. Short alignment sleeve pins are used at the junctures of latitudinal beams and radial beams. The foam rubber pipe insulation that encapsulates the post tension conduits not only allows for movement within the system but also allows for corrections in any slightly misaligned conduits and provides play in the connection during erection.

Figure 1D:
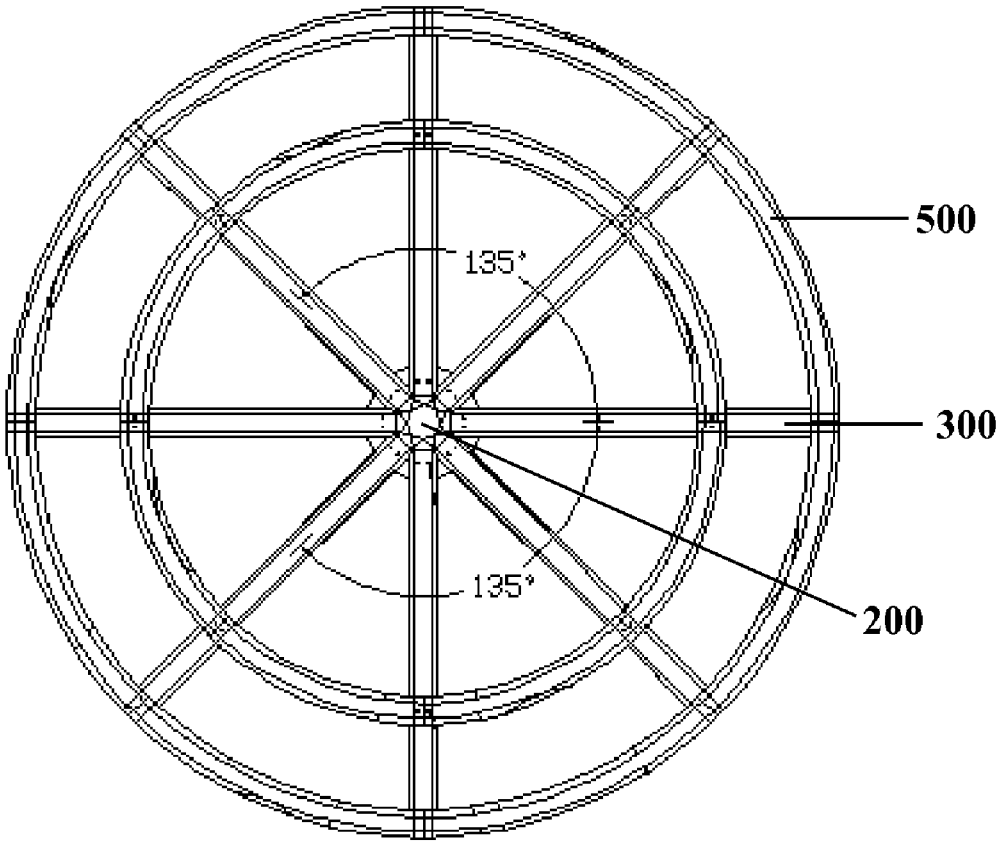
FIG. 1D is a schematic illustration of a typical horizontal post-tension cable routing with two or four routings through each beam.
Figure 2A:
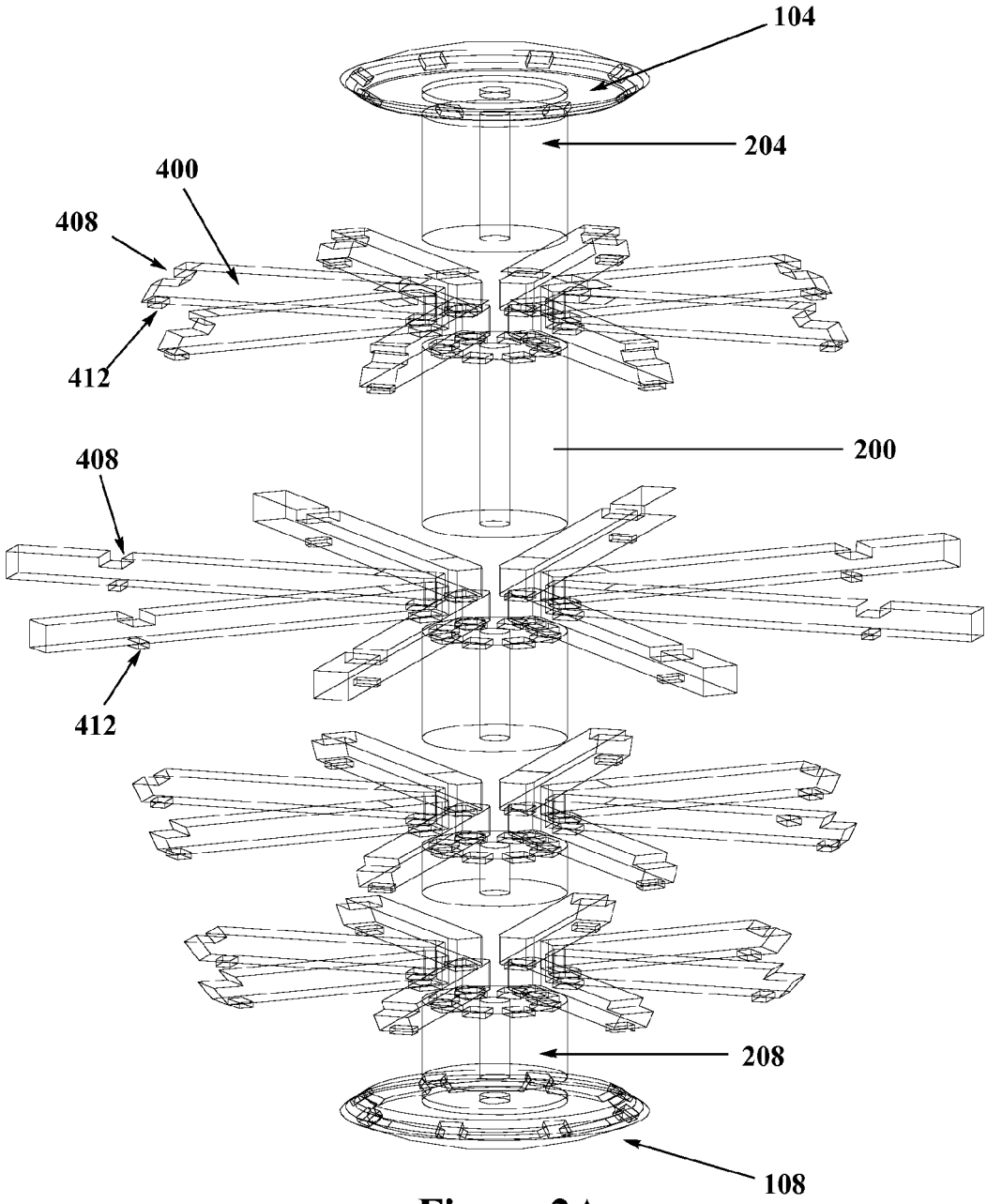
FIG. 2A is a schematic illustration showing central beam and a plurality of radial beam sets.
Figure 2B:
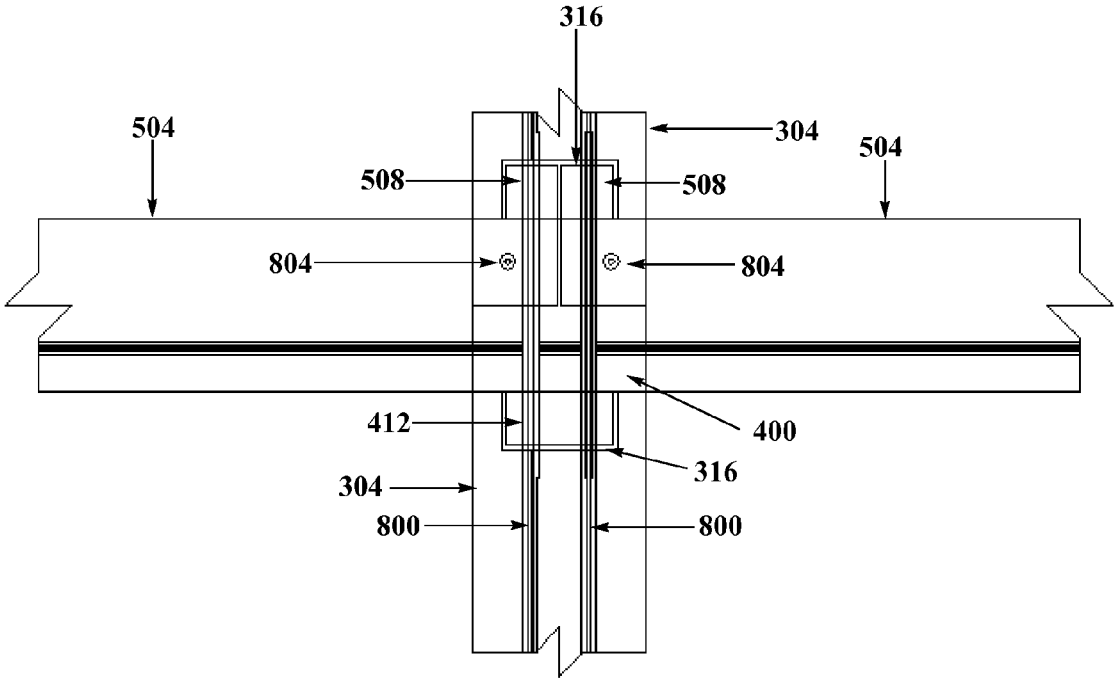
FIG. 2B is an illustration showing how one particular embodiment of the invention provides interlocking interface of the three different beams.

FIG. 1D is a schematic illustration of horizontal Post-tensioned Cable Layout at floor and at equator (other floors are similar). FIG. 1D shows one particular embodiment of a typical horizontal post-tension cable routing with two or four routings through each beam. A particular cable routing in the curved members (i.e., latitudinal support beams 500) consists of two cables that mirror each other while intersecting just before they terminate at an inner or outer face of the beam. Often, these intersections and terminations occur at staggered locations. Such arrangement lead to stronger building structure as the weakest point (i.e., termination points) are not concentrated in one particular side or area of the building structure. The cable routing at the straight beams involves a particular cable going perpendicularly through the end of a latitudinal beam, into the corresponding conduit in the end of a radial beam, through the length of the radial beam, through the central beam, out along the length of the opposing radial beam (or out along the length of a corresponding radial beam forty-five degrees from the opposing radial beam in order to decrease the number of cable intersections in the central column and to maximize the allowable diameter of a hollow shaft at the center of the central column) and going perpendicularly through the end of the corresponding latitudinal beam.

FIG. 3 is an isometric view of post-tensioned cables in one particular embodiments of building structure. In particular, this view shows the post-tensioned cable scheme as if the cables were running radially, latitudinally and longitudinally through the beams and vertically through the central beam. Here, pairs of cables are seen running parallel to each other while other schemes may involve different number (e.g., one, three, or four) of cables running parallel to each other. Regardless of the particular cable scheme, in some embodiments the structural members of building structures of the invention are tied together in up to three different directions.

FIG. 1B is a blow-up view of structural members in one particular building structure. This figure depicts the manner in which the structural members of the building structure of the invention fit together. With the lower cap 108 cast in place within the appropriate depression in the sub-grade, with the lowest segment of central beam 200 cast upon lower cap 108, and a particular lowest longitudinal beam set and braced in place, the corresponding lowest radial beam is hoisted into position to span between the central beam and the longitudinal beam. After the first radial beam is secured with all the sleeve-pins but one, the adjacent set of radial and longitudinal beams is put in place and secured in a similar manner. After the grooves cast in the adjoining beams are coated with a liquid rubber joint compound, a lower wall panel is lowered into place between the two sets of installed beams. This assembly is then cinched together with the appropriate latitudinal beam and the remaining sleeve pins. This procedure is followed until all of the lowest layer of beams and wall panels are in place (the last wall panel placement is facilitated by oversized grooves in the longitudinal beams and play in the conduits into which the sleeve pins are placed). At this point, the post-tension cables are threaded through all the beams that have been placed. The excess length of the cables which go through the central column and the longitudinal beams is left coiled up at one end or the other to allow for continuing the threading of the cables into subsequent lifts. Once all of the cables have been threaded into position, the latitudinal and radial cables are stressed. The lowest floor is then installed. Including an intermediate backfill with a flowable low strength grout or water jetted sand and a lift of longitudinal cable intersections and terminations, this technique is followed for all the lower levels until the main level floor is installed. The structure is then backfilled to just below the windows of the garden level.

As the structure above the main floor is erected, the sequence varies to allow for the wall panels being broader at the bottom than at the top. In this case, a radial and longitudinal pair of beams, 400 and 504, respectively, is set, pinned and braced before the adjoining wall panel is slid into position and braced. Then, the adjacent pair of radial and longitudinal beams, 400 and 504, respectively, is placed into position and the assembly is cinched together with a latitudinal beam 304 and the remaining sleeve pins. This procedure is followed (with the wall panels being omitted at blank bays) until the last latitudinal beam 304 is placed above a blank bay. The post-tension cables 800 are then threaded and stressed before the upper floor is installed. After the upper segment of the central beam has been placed, upper cap 104 is lowered into position (being guided by sleeve pins protruding into the central beam). With upper cap 104 in place, longitudinal beams 304 and the upper wall panels are set into position and braced with protuberance 508 (e.g., top stubs) of longitudinal beams 504 and the wall panels resting against the edge of upper cap 104. Once this is accomplished, upper cap 104 is lifted slightly and the braces are adjusted to allow protuberance 508 (e.g., stubs at the top) of longitudinal beams 504 and the tops of the wall panels to fit into the recesses in upper cap 104 as the cap 104 is lowered back into place. After sleeve pins are inserted into the longitudinal beams through exposed slots in the top of upper cap 104, the remaining cables 800 are threaded through upper cap 104 and the longitudinal beams, and then stressed before the exposed slots are grouted full. The structure now looks similar to that depicted in FIGS. 1A and 1C, except that in these drawings the structure's wall panels have been omitted for better viewing of the interior elements.

Building structures of the invention offer the added strength of a complete, continuous sphere along with an internal framework for establishing floors and room divisions. By utilizing pre-cast structural members that are laced together with post-tensioned cables, the structure is given the flexibility of a multitude of hinged connections and the integral strength of members working in compression with one another.

The foregoing discussion of the invention has been presented for purposes of illustration and description. The foregoing is not intended to limit the invention to the form or forms disclosed herein. Although the description of the invention has included description of one or more embodiments and certain variations and modifications, other variations and modifications are within the scope of the invention, e.g., as may be within the skill and knowledge of those in the art, after understanding the present disclosure. It is intended to obtain rights which include alternative embodiments to the extent permitted, including alternate, interchangeable and/or equivalent structures, functions, ranges or steps to those claimed, whether or not such alternate, interchangeable and/or equivalent structures, functions, ranges or steps are disclosed herein, and without intending to publicly dedicate any patentable subject matter.

What is claimed is:

1. A structural member of a building comprising a central column and a plurality of beams that are held together at least in part by a post-tension cable within each of said beam, wherein at least some of said beams are attached to said central column.

2. The structural member of claim 1, wherein each of said beam comprises a body and at least one joint section for attaching to another beam.

3. The structural member of claim 1, wherein each of said beam comprises a plurality of post-tension cables.

4. The structural member of claim 1, wherein said post-tension cable is located within the body of said beam.

5. The structural member of claim 4, wherein said body of the beam further comprises a conduit and wherein said post-tension cable is located within said conduit.

6. The structural member of claim 1, wherein the plurality of beams form a dome-shape.

7. The structural member of claim 1, wherein the plurality of beams form a substantially spherical shape.

8. The structural member of claim 1, wherein said beams are held in place relative to said central column at least in part by said post-tension cable.

9. The structural member of claim 1, wherein said central column is segmented.

10. The structural member of claim 1, wherein said central column comprises a plurality of radially emanating beams.

11. A building structure comprising:

a central beam having an upper portion and a lower portion;

a plurality of longitudinal support beam sets, each set of said longitudinal support beam extends substantially from the upper portion of said central beam to substantially the lower portion of said central beam, wherein each longitudinal support beam set comprises:

a plurality of vertical sectional beams, each of said vertical sectional beam having:

first and second ends that vertically define upper and lower ends of said vertical sectional beam; and outer and inner surfaces that radially define from said central beam an outer surface and an inner surface, respectively, of said vertical sectional beam, and wherein each vertical sectional beam is in the form of a vertical arc;

at least one set of radial beams, wherein each radial beam in the set extends radially from different location but substantially the same vertical position of said central beam, each radial beam having a distal end that is distal to said central beam; and at least one set of latitudinal support beams that substantially defines a circumference of said set of radial beams, wherein said set of latitudinal support beams comprises a plurality of horizontal sectional beams, each of said horizontal sectional beam having:

first and second ends that horizontally define ends of said horizontal sectional beam; and outer and inner surfaces that radially define from said central beam an outer surface and an inner surface, respectively, of said horizontal sectional beam, and wherein each horizontal sectional beam is in the form of a horizontal arc, wherein the distal end of each of said radial beam is connected to the first or the second end of said vertical sectional beam and first or the second end of said horizontal sectional beam.

12. The building structure of claim 11 further comprising a skin supported at least in part by said longitudinal support beam beams.

13. The building structure of claim 11, wherein said building structure comprises a plurality of latitudinal support beam sets.

14. The building structure of claim 11, wherein said building structure comprises a plurality of radial beam sets.

15. The building structure of claim 11, wherein the number of radial beam sets equal to the number of latitudinal support beam sets.

16. The building structure of claim 15, wherein each latitudinal support beam set defines the circumference of the corresponding radial beam set.

17. The building structure of claim 11, wherein said set of radial beams define a floor.

18. The building structure of claim 11 further comprising a post-tension cable within each of said beam.

19. The building structure of claim 18, wherein said post-tension cable is encapsulated within a body of said beam.

* * * * *